United States Patent [19]

Leifeld

[11] Patent Number: 4,945,610

[45] Date of Patent: Aug. 7, 1990

[54] DEVICE FOR FEEDING A FIBER LAP TO A PROCESSING ROLLER OF A FIBER PROCESSING MACHINE

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 313,867

[22] Filed: Feb. 23, 1989

[30] Foreign Application Priority Data

Feb. 25, 1988 [DE] Fed. Rep. of Germany ..... 3805829

[51] Int. Cl.[5] ..... D01G 23/00; D01G 15/20

[52] U.S. Cl. ..... 19/105

[58] Field of Search ..... 19/105; 414/18; 384/42

[56] References Cited

U.S. PATENT DOCUMENTS

| | | | |
|---|---|---|---|
| 2,442,333 | 6/1948 | Bacon | 19/105 |
| 3,373,461 | 3/1968 | Bessette | 19/105 X |
| 3,579,744 | 5/1971 | Menzies | 19/105 X |
| 3,889,822 | 6/1975 | Ross | 414/18 |
| 4,346,500 | 8/1982 | Demuth . | |

FOREIGN PATENT DOCUMENTS

| | | |
|---|---|---|
| 900071 | 12/1953 | Fed. Rep. of Germany . |
| 1172166 | 6/1964 | Fed. Rep. of Germany . |
| 2826102 | 2/1979 | Fed. Rep. of Germany . |
| 1551237 | 11/1968 | France . |
| 1034692 | 6/1966 | United Kingdom . |

OTHER PUBLICATIONS

Karpow, "Der Speisetisch mit verstehendem Profil an der Karde", Z.ges. Textilind. 62, 1960, No. 23 (1. Dezemberheft) pp. 1023–1025.

*Primary Examiner*—Werner H. Schroeder
*Assistant Examiner*—Ismael Izaguirre
*Attorney, Agent, or Firm*—Spencer & Frank

[57] ABSTRACT

A device for advancing a fiber lap in a feeding direction to a processing roller of a fiber processing machine includes a feed roller and a feed table which together define a gap. The gap has a length extending parallel to the feeding direction and a width defined by the distance between the feed roller and the feed table. The width increases along the length in an upstream direction as viewed in the advancing direction. The feed roller and the feed table are relatively movable towards and away from one another. The gap further has a downstream terminal length portion forming a small-width clamping zone defined by a short circumferential length portion of the feed roller and an arcuate length portion of the feed table. The arcuate length portion terminates at the downstream terminal edge of the feed table.

15 Claims, 3 Drawing Sheets

1
2
2'
2b
3
4
5
6
7
8
9
10
11
12
13
14
15
16
A

DEVICE FOR FEEDING A FIBER LAP TO A PROCESSING ROLLER OF A FIBER PROCESSING MACHINE

CROSS REFERENCE TO RELATED APPLICATION

This application claims the priority of Federal Republic of Germany Application No. P 38 05 829.4 filed Feb. 25, 1988, which is incorporated herein by reference.

BACKGROUND OF THE INVENTION

This invention relates to a feeding device for advancing a fiber lap or similarly composed fiber mass to a processing roller of a fiber processing machine such as a licker-in of a card or a sawtooth roller of an opener. The device is of the type which has a feed roller and a feed table associated therewith. The feed roller and the feed table together define a gap which ends at the frontal (downstream) edge of the feed table and which widens in a direction opposite the rotary direction of the feed roller, away from the processing roller and the frontal table edge.

In a known arrangement—as viewed in a sectional plane perpendicular to the roller axis—the shape of a feed table cooperating with a feed roller is formed of one part of a circular contour and a tangentially merging straight line. The working gap between the feed table and the feed roller depends from the diameter of the feed roller and the location of the feed roller axis relative to the center of the circle in which the circular contour of the feed table lies. The two geometrical features, that is, the dependence from the diameter and the eccentricity of the center point and the feed roller axis both in the horizontal and in the vertical position determine the shape of the intake gap defined by the feed roller and the feed table. In the known arrangement, in the zone between the feed roller and the circular part of the feed table there are obtained constant gaps or gaps which narrow in the direction of material feed. These gap geometries as well as the intake zones which are obtained in their geometry from the straight-line course of the feed table and the circular arc of the feed roller, do not result in optimal intake, transport and clamping conditions during the operation of the feed system formed of a feed roller and feed table.

For advancing the fiber lap between the feed table and the feed roller only a moderate pressure between the two components is needed. Without such pressing force, however, the fiber lap cannot be advanced. An excessively high pressure, on the other hand, leads, because of friction, to disturbances in the feed (jarred advance, difficult transport or short-period stoppages). The required transport pressure is entirely different in magnitude from the required clamping pressure at the end of the gap between the feed roller and the feed table. In the latter case, a high pressure should be present which exerts, through frictional surfaces in the clamping gap, a holding effect against the tearing action of the processing roller (licker-in or sawtooth roller). Thus, the last-named pressure is higher than the required transport pressure prevailing up to the clamping location (clamping zone). At each location the pressure is generated by several force components which are at all times maintained in equilibrium. The force components are determined by the pressing force of the pressing system such as spring force, gap size at each location in conjunction with the material thickness and density as well as the complex resilient behavior of the fiber material at each location.

By shaping the feed table such that the arcuate surface thereof extends concentrically to the surface of the feed roller, there is obtained a constant distance between the two arcuate surfaces, that is, the convex feed roller surface and the concave feed table surface. As a result, subsequent to a tangential intake of the fiber material, immediately a high pressure prevails which compresses the material. Shortly upstream of the tangential intake location there occurs furthermore a rapid and strongly increasing compression of the fiber material. This too, may lead to disturbances in the intake of the material. It has been found that the compressing force which is necessary to densify the fiber lap in the gap is dependent from the conveying speed. Thus, particularly at high intake speeds the rapid increase of the densifying (compressing) force causes disturbances in the fiber lap during the intake phase. If the feed roller is pressed during operation against the feed table or conversely, a pressure bed is obtained which, because of the morphological behavior of the fiber material cushion, has an approximately constant pressure as viewed circumferentially. The pressure must be, for technological reasons of such magnitude that a positive, determined clamping is generated in the clamping gap at the end of the feed table. If the same pressure is already present over the entire compression zone as explained above, the pressure is excessively high in the frontal (upstream) range of the transport zone, where the pressure is required only for maintaining the conveyance of the material. An excessive pressure leads to impermissible friction forces which alter the fiber lap structures and also leads to disturbances in the material feed. Furthermore, the drive mechanism may be overloaded.

In another known feeding device the arc of the feed table (clamping zone) adjoining the feed table edge is long. The arc encompasses undifferentiated the entire convex surface of the feed table. The arc of the feed table situated opposite the curvature of the feed roller, that is, the clamping zone, extends through approximately 70°, related to the axis of the feed roller. The distance between the feed table and the feed roller increases gradually and uniformly from the downstream feed table edge, and the clearance between feed roller and feed table (clamping gap) is not subdivided into different zones. Immediately upstream of the feed table there is provided a unidirectionally rotatably supported pressing body which presses the fiber material against the feed roller. It occurs during operation that thickened portions in the fiber material—such thickened portions appear irregularly and are distributed over the width of the fiber material—enters into the small opening gap at the beginning of the feed table; as a result, the feed table is lifted by the feed roller against the pressing force (such as the force of a spring). By virtue of this occurrence, however, at the same time, the distance between the feed table and the feed roller at the frontal edge of the feed table is increased, whereby the withholding force (pressing force) on the fiber material is relaxed. As a result, the fiber processing roller is capable of suddenly tearing out large quantities of fiber material from the fiber lap. It is a further disadvantage of this prior art structure that by virtue of the relatively long clamping zone, the fiber material is, during conveyance, exposed to a high pressure over an extensive length; this may adversely affect the structure of the fiber lap. Also, such a high pressure prevents a further conveyance within the long clamping gap. Further, it is also a disadvantage of this arrangement that the additional pressing body renders the apparatus structurally more complex.

SUMMARY OF THE INVENTION

It is an object of the invention to provide an improved fiber lap feeding device of the above-outlined type from which the discussed disadvantages are eliminated and which in particular ensures an improved guidance of the fiber lap to the fiber processing roller such as a licker-in or a sawtooth roller.

This object and others to become apparent as the specification progresses, are accomplished by the invention, according to which, briefly stated, the arc of the feed table at the clamping zone immediately adjoining the edge of the feed table is short and further, in the clamping zone, the distance between the feed table and the feed roller is small.

By virtue of the fact that according to the invention the clamping zone is short and the gap width is narrow, the required large clamping pressure for retaining the fiber material from the licker-in is limited to the zone immediately upstream of the downstream edge of the feed table. By virtue of this arrangement, the pressure on the fiber lap in the zones upstream of the clamping zone, that is, in the intake zone and the conveying zone, is reduced and, as a result, the fiber lap is handled gently and its conveyance is facilitated. If a thickened area in the fiber lap enters the gap at the upstream end of the zone of cooperation between the feed roller and the feed table, the feed table and the feed roller are moved away from one another only slightly, so that the withholding force in the clamping zone at the end of the gap is continuously maintained and thus the fiber processing roller is not able to tear out undesired quantities of fiber from the fiber lap.

Since all of the three requirements such as fiber lap intake, conveyance and clamping require predetermined distances between the feed roller and the feed table which are not realized by the geometry of known arrangements, three zones are formed in which the distances are determined predominantly for the respective task. "Predominantly" is intended to mean that, for example, in the "clamping" zone a conveyance of the fiber lap has to take place too, but the clamping function has priority. In the "conveying" zone the clamping function need not be present for the purpose of obtaining a good combing by the licker-in. In the "intake" zone a conveyance has to take place also; predominantly, however, the geometry of the arrangement is so designed that the intake function takes priority. By virtue of such intake function, in the intake zone the fiber lap is—as opposed to the free positioning on a feed tray upstream of the intake zone—passed through a conveying channel in which at all sides pressure is exerted on the fiber lap. The three zones (clamping, conveying and intake zones) may be measured by consecutive angles $\alpha$, $\beta$ and $\gamma$, whose vertex lies on the feed roller axis. The distance between the feed roller and the feed table is maintained approximately constant in the clamping zone whose angle $\alpha$ is, for example, approximately 15°. If such a distance is considered to be of unit magnitude, the respective distances between the feed table and the feed roller in the intake zone and the clamping zone are approximately 2–5.

The feed roller/feed table assembly is so constructed that a basic distance is determined therebetween by means of an abutment which limits the relative motion between the feed roller and the feed table, and against which the movable component (feed table or feed roller) is pressed by a spring. As the fiber material runs into the gap defined between the feed table and the feed roller, the fiber material, dependent upon its thickness, overcomes the force of the spring and moves the movable member to a greater or lesser extent away from the abutment. The basic distance determines, for a given thickness of fiber lap, the magnitude of the pressure generated in the zones of compression, and thus distance variations between the feed table and the feed roller affect the pressure. The distances are, according to the invention, so designed along the pressure zone that at the fiber material intake a large distance is provided which decreases in the conveying zone towards its end (in a direction adjacent the licker-in) and further, the required clamping force essentially prevails only at the end of the clamping zone. In this manner, a positive and settable clamping is achieved. Also, a significant advantage is obtained as concerns an improved fiber sliver uniformity in the range of short-term fluctuations, resulting in improved Uster-CV values. Furthermore, the speed of conveyance through the conveying zone is more uniform. Also, the drive system may be designed more advantageously and energy input may be saved because the fiber lap conveyance is easier to perform.

Preferably, the clamping zone is approximately 8–20 mm long (as viewed in the conveying direction) in case of a feed roller diameter of approximately 100 mm. Preferably, the distance between the feed roller and the feed table is approximately 0.50 to 0.70 mm in the widest part of the gap in the clamping zone, in case of a feed roller diameter of, for example, approximately 100 mm. A further advantage is achieved by providing the conveying zone with a lining having a small coefficient of friction. This improves the conveying conditions, and thus the energy input for the conveyance may be reduced. The lining terminates approximately 30–15 mm upstream of the end of the feed table, that is, prior to the exit of the material, since the exit zone requires a higher coefficient of friction for achieving a clamping effect.

DESCRIPTION OF THE PREFERRED EMBODIMENT

Figure 1:
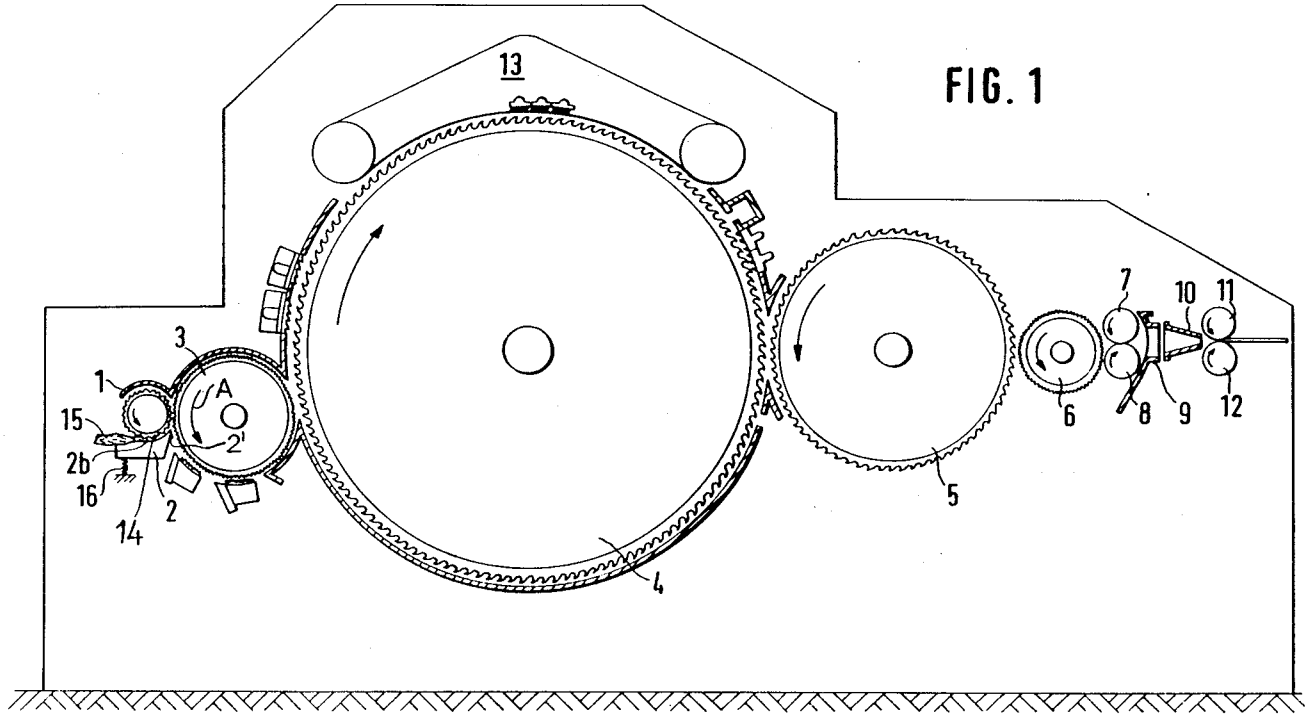
FIG. 1 is a schematic side elevational view of a carding machine incorporating a preferred embodiment of the invention.

Turning to FIG. 1, there is illustrated therein a known carding machine which may be, for example, an EXACTACARD DK 740 model manufactured by Trützschler GmbH & Co. KG, Mönchengladbach, Federal Republic of Germany. The carding machine has a feed roller 1, a feed table 2 cooperating therewith, a licker-in 3, a carding cylinder 4, a doffer 5, a stripping roller 6, crushing rollers 7 and 8, a web guiding element 9, a sliver trumpet 10, calender rollers 11 and 12 as well as travelling flats 13. The feed table 2 is upwardly biased by a compression spring 16. The feed table 2 forms, together with the feed roller 1, a gap 14 which extends from the edge 2' (that adjoins the licker-in 3) of the feed table 2 away therefrom and which widens in the upstream direction, that is, in a direction away from the edge 2' and opposite the rotary direction A of the feed roller 1.

Figure 2:
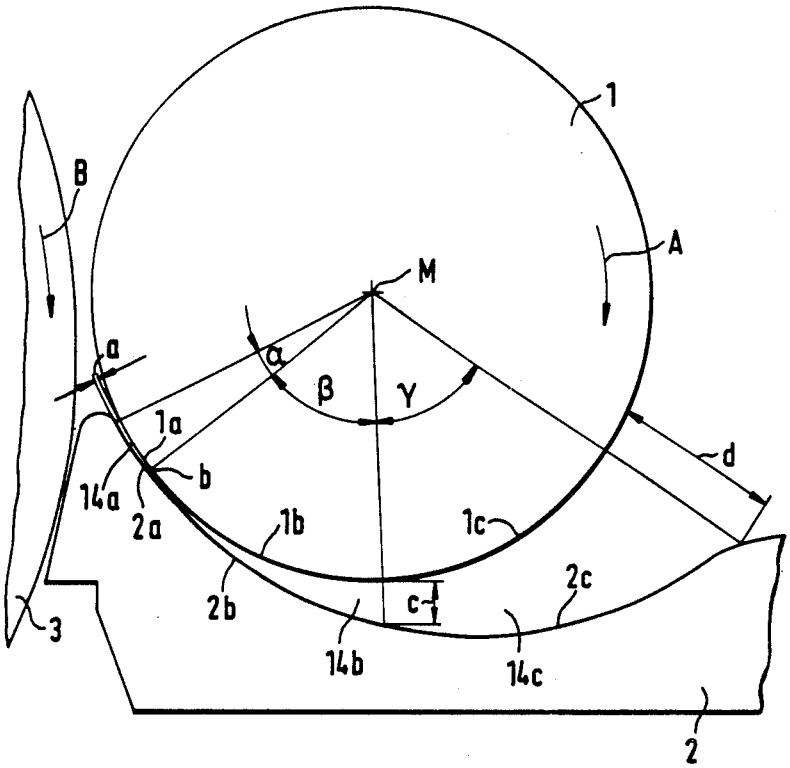
FIG. 2 is a schematic side elevational view of the preferred embodiment.

Turning to FIG. 2, the angles $\alpha$, $\beta$ and $\gamma$ designate a clamping zone, a conveying zone and an intake zone, respectively. The vertex of the three angles lies on the axis M of the feed roller 1. The angle o is approximately 15° in case the feed roller 1 has a diameter of 100 mm.

The circumferential arcuate portion of the feed roller 1 in the clamping zone $\alpha$ is designated at 1*a*, in the conveying zone $\gamma$ at 1*b* and in the intake zone $\beta$ at 1*c*. The arcuate portion of the feed table 2 is designated in the clamping zone $\alpha$ at 2*a*, in the conveying zone $\beta$ at 2*b* and in the intake zone $\gamma$ at 2*c*. *The* clearance between the feed roller 1 and the feed table 2 is designated at 14*a* in the clamping zone $\alpha$, at 14*b* in the conveying zone $\beta$ and at 14*c* in the intake zone $\gamma$. The distance between the feed roller 1 and the feed table 2 (clearance or gap) is a at the downstream end and b at the upstream end of the clamping zone $\alpha$, c at the upstream end of the conveying zone $\beta$ and d at the upstream end of the intake zone $\gamma$. It is noted that the upstream end of the clamping zone $\alpha$ coincides with the downstream end of the conveying zone $\beta$ and the upstream end of the conveying zone $\beta$ coincides with the downstream end of the intake zone $\gamma$. In case of a feed roller diameter of 100 mm, a may be 0.1 and b may be 0.6 mm.

The taper of the gap between the feed roller 1 and the feed table 2 may have, for example, the following ratios:

In the intake zone $\gamma$, from 10–25 (distance d) to 1 (distance c);

In the conveying zone $\beta$, from 15–40 (distance c) to 1 (distance b); and In the clamping zone $\alpha$, from 2–5 (distance b) to 1 (distance a).

The clearance 14 between the feed roller 1 and the feed table 2 widens in the upstream end region of the clamping zone 14*a* at a greater rate than in the remaining part thereof.

Figure 3A:
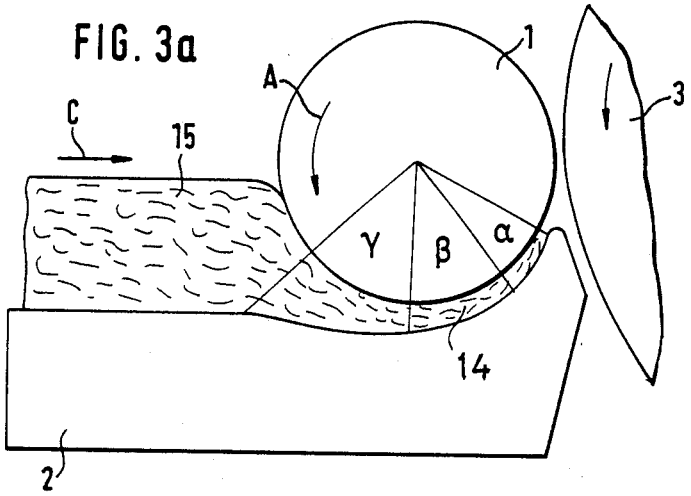
FIG. 3*a* is a schematic side elevational view of the preferred embodiment shown on a reduced scale relative to FIG. 2 and illustrating the presence of fiber material.
Figure 3B:
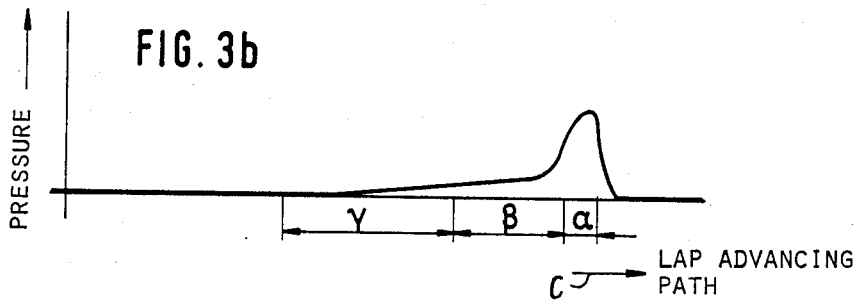
FIG. 3*b* is a diagrammatic view illustrating the pressure exerted on the fiber material along the travelling path as distributed according to the preferred embodiment.

Turning to FIG. 3*a*, the fiber lap 15 runs in the direction of the arrow C into the gap 14 between the feed roller 1 and the feed table 2. Upstream of the intake zone $\gamma$ the fiber lap 15 lies freely on the feed table 2 without pressure. In that zone the feed table 2 has a convex course as shown or may be planar. As soon as the fiber lap 15 is grasped by the feed roller 1, a pressing force is exerted on the fiber lap 15. As shown in FIG. 3*b*, the pressure gradually increases in the direction C in the intake and conveying zones $\gamma$ and $\beta$ and jumps to its maximum value in the clamping zone $\alpha$.

Figure 4:
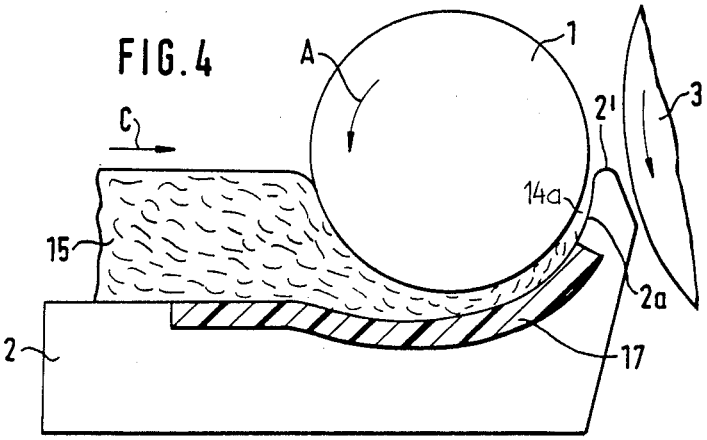
FIG. 4 is a schematic side elevational view of the preferred embodiment, provided with a friction-reducing lining.

Turning to FIG. 4, on the upper surface of the feed table 2 there is provided a low-friction lining 17. The low-friction lining 17 may be a plastic, particularly a wearresistant synthetic material, such as ZX 100, manufactured by Fa. Wolf, Kerpen, Federal Republic of Germany. The lining 17 terminates shortly upstream of the arcuate portion 2*a* of the feed table 2 in the clamping zone 14*a*, at a distance of approximately one fiber length to a minimum of one half fiber length.

It will be understood that the above description of the present invention is susceptible to various modifications, changes and adaptations, and the same are intended to be comprehended within the meaning and range of equivalents of the appended claims.

What is claimed is:

1. In a device for advancing a fiber lap in a feeding direction to a processing roller of a fiber processing machine; said device including a feed roller and a feed table, together defining a gap having a length extending parallel to the feeding direction and a width defined by the distance between the feed roller and the feed table; said width increasing along said length in an upstream direction as viewed in said advancing direction; said feed roller and said feed table being relatively movable towards and away from one another; said feed table having a downstream terminal edge; said gap having a downstream terminal length portion forming a clamping zone defined by a circumferential length portion of the feed roller and an arcuate length portion of said feed table; said arcuate length portion terminating at said downstream terminal edge; the improvement wherein said gap further has an additional length portion forming a conveying zone situated immediately adjacent said clamping zone upstream thereof; said circumferential length portion is shorter than the length of the gap in the conveying zone and the width of the gap in the clamping zone is significantly smaller than the width of the gap in the conveying zone.

2. A device as defined in claim 1, wherein the length of said clamping zone is approximately 8 to 20 mm.

3. A device as defined in claim 1, wherein said arcuate length portion of said feed table has an angle of approximately 10 to 20°; said angle having a vertex lying on the axis of said feed roller.

4. A device as defined in claim 1, wherein the width of the gap in said clamping zone has a maximum value of approximately 0.50 to 0.70 mm.

5. A device as defined in claim 1, wherein the ratio of the width of the gap at an upstream end of the clamping zone to the width of the gap at a downstream end of the clamping zone is approximately from 2 : 1 to 7 : 1.

6. A device as defined in claim 1, wherein the rate of change of the width of the gap along the length of the gap is greater along an initial, upstream length portion of the clamping zone than along a terminal, downstream length portion of the clamping zone.

7. A device as defined in claim 1, wherein said feed table has a concave curvature along the length of said gap and further wherein said feed table has a convex curvature adjoining said gap at an upstream end thereof, and viewed along said feeding direction.

8. A device as defined in claim 1, wherein said feed table has a concave curvature along the length of said gap and further wherein said feed table has a planar length portion adjoining said gap at an upstream end thereof.

9. A device as defined in claim 1, further comprising a low-friction lining covering said feed table upstream of said clamping zone.

10. A device as defined in claim 9, wherein said lining has a downstream end situated approximately 15–30 mm from said terminal edge of said feed table.

11. A device as defined in claim 9, wherein said lining has a downstream end situated substantially at an upstream end of said clamping zone.

12. In a device for advancing a fiber lap in a feeding direction to a processing roller of a fiber processing machine; said device including a feed roller and a feed table, together defining a gap having a length extending parallel to the feeding direction and a width defined by the distance between the feed roller and the feed table; said width increasing along said length in an upstream direction as viewed in said advancing direction; said feed roller and said feed table being relatively movable towards and away from one another; said feed table having a downstream terminal edge; said gap having a downstream terminal length portion forming a clamping zone defined by a circumferential length portion of the feed roller and an arcuate length portion of said feed table; said arcuate length portion terminating at said downstream terminal edge; the improvement wherein said circumferential length portion is short and the width of the gap in the clamping zone is small and further wherein said feed table has a concave curvature along the length of said gap and further wherein said feed table has a convex adjoining said gap at an upstream end thereof, and viewed along said feeding direction.

13. In a device for advancing a fiber lap in a feeding direction to a processing roller of a fiber processing machine; said device including a feed roller and a feed table, together defining a gap having a length extending parallel to the feeding direction and a width defined by the distance between the feed roller and the feed table; said width increasing along said length in an upstream direction as viewed in said advancing direction; said feed roller and said feed table being relatively movable towards and away from one another; said feed table having a downstream terminal edge; said gap having a downstream terminal length portion forming a clamping zone defined by a circumferential length portion of the feed roller and an arcuate length portion of said feed table; said arcuate length portion terminating at said downstream terminal edge; the improvement comprising a low-friction lining covering said feed table upstream of said clamping zone; and further wherein said circumferential length portion is short and the width of the gap in the clamping zone is small.

14. A device as defined in claim 13, wherein said lining has a downstream end situated approximately 15–30 mm from said terminal edge of said feed table.

15. A device as defined in claim 13, wherein said lining has a downstream end situated substantially at an upstream end of said clamping zone.

* * * * *